US008205886B1

(12) United States Patent
Caster, Jr.

(10) Patent No.: US 8,205,886 B1
(45) Date of Patent: Jun. 26, 2012

(54) DIDACTIC SKILL DEVELOPING PUZZLE

(76) Inventor: James E. Caster, Jr., Frisco, TX (US)

( * ) Notice: Subject to any disclaimer, the term of this patent is extended or adjusted under 35 U.S.C. 154(b) by 280 days.

(21) Appl. No.: 12/784,750

(22) Filed: May 21, 2010

(51) Int. Cl.
*A63F 9/08* (2006.01)

(52) U.S. Cl. ..... 273/158; 273/159

(58) Field of Classification Search ..... 273/156, 273/158, 159; D21/481, 482
See application file for complete search history.

(56) References Cited

U.S. PATENT DOCUMENTS 2,091,191 A * 8/1937 Van Luven ..... 273/159
D172,310 S * 5/1954 Riddle ..... D21/482
3,758,114 A * 9/1973 Ludwig ..... 273/159
D406,866 S * 3/1999 Reid ..... D21/482
* cited by examiner

*Primary Examiner* — Steven Wong
(74) *Attorney, Agent, or Firm* — Buskop Law Group, PC; Wendy Buskop

(57) ABSTRACT

A didactic skill developing puzzle having a center segment with a first end and a second end, a right side large loop, a right side small loop, a left side large loop, a left side small loop, and at least one continuous loop of material is described herein. The right side large loop can have a first snap connection, and the right side small loop can have a second snap connection. The first snap connection can removeably engage the second snap connection through the first web to form a first connected end. The left side has an identical pair of large and small loops and connections for engaging the second web to form a connected second end. The loops do not touch, and a continuous loop of material with an openable clasp is positioned between the loops allowing a user to experience a three dimensional maze.

19 Claims, 6 Drawing Sheets

DIDACTIC SKILL DEVELOPING PUZZLE

FIELD

The present embodiments generally relate to a didactic skill developing puzzle with logic development and mathematical skill development features.

BACKGROUND

A need exists for a tactile puzzle and a system for improving logic and mathematical skills in users, such as users from age eight to adulthood.

A need exists for a puzzle that can be assembled from a plurality of parts using snap fit connections, which can promote a message while providing a single functional version for problem solving.

A need exists for a puzzle usable by vision impaired people that can provide a "smellable" feature while providing a complex math problem and a tactile puzzle. The invention can enable vision impaired people to enjoy the puzzle and to be able to solve two puzzles simultaneously by using ropes embedded with two different smells.

The present embodiments meet these needs.

BRIEF DESCRIPTION OF THE FIGURES

The detailed description will be better understood in conjunction with the accompanying drawings as follows.

Figure 1:
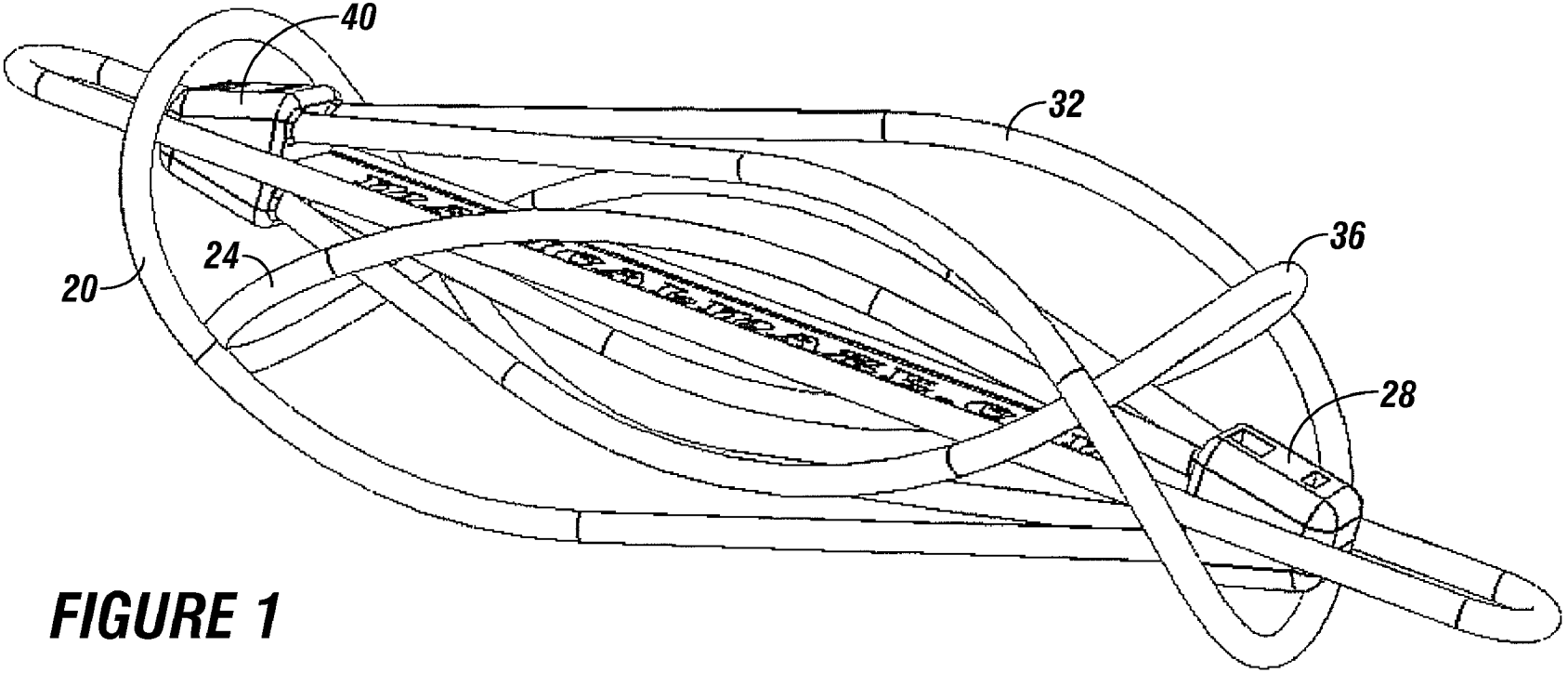
FIG. 1 is a perspective view of an assembled didactic skill developing puzzle.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that they can be practiced or carried out in various ways.

The present apparatus incorporates a plurality of parts which can be fit together in a unique snap-fit construction to provide a detachable and re-connectable four loop structure that can simultaneously enhance motor coordination and thinking skills.

One or more embodiments relate to a mathematical puzzle for improving logic skills.

The embodiments provide didactic skill development for children and can engage the elderly to maintain their hand skills and brain acuity.

In one or more embodiments, a material can be placed around a center segment of the puzzle, and a user can be allowed to maneuver the material around while crossing large and small loops in a weaving process to ultimately remove the material from the puzzle without opening a clasp.

One or more embodiments of the puzzle can require nine steps to successfully complete the puzzle. When a user discovers one of the correct steps, the user can memorize that step. The user can order and reorder steps to successfully complete the puzzle. The puzzle can require memorizing the correct steps in the correct order to succeed, which can enhance both long and short term memory.

The puzzle can also aid a child's concentration. Children, such as children ages eight or older, often have a need to develop concentration, which can be developed through motivated memorization. Faster completion of the puzzle can be a motivating cause for increased concentration in children, which can lead to development of better motor skills as a result.

The puzzle can aid with cognitive and physical therapy for elderly people. Patients with multiple sclerosis or Lou Gehrig's disease need to use their fingers or their muscles degrade. This puzzle can assist with muscle development of the fingers to help those individuals with diseases of this kind.

The invention can improve the logic thinking abilities of a user by presenting a physical "if . . . then" situation with each move of the puzzle. By working with the puzzle and improving logical thinking, the user's test taking skills can improve. It is anticipated that this puzzle can help students score higher on an IQ test.

The invention relates to a special logical puzzle that can have five major elements mounted on a center segment. The center segment can have additional loop structures at each end. When the elements are assembled, a material, such as a chain, can pass around the center segment of the puzzle. The chain can be manipulated around the now connected loops without disengaging the loops from the center segment at the webs.

The puzzle can be formed by injection molding of synthetic resinous material, which can have a degree of resiliency upon curing, such that the puzzle will not be readily damaged if dropped.

Surface coloring can be added to the puzzle. Surface ornamentation, such as glitter, can be added to the resin prior to molding, which can improve the attraction of the puzzle.

Smell substances, such as an orange smell, can be added to the resinous material to enable a visually impaired person to work the puzzle. The smell substance can also enable a visually impaired person to locate the puzzle.

Small versions of the puzzle, such as a six inches long by four inches wide version, can have the orange smell, while a larger version, such as twelve inches long by six inches wide version, can have a lavender smell.

The ropes or materials for the puzzle can have different smells as well. Embodiments can include two ropes, each having a different smell that can be placed on the material.

A visually impaired person can work each rope separately while simultaneously performing the complex logic required for the two materials without tangling the ropes. The smell substances can include bubblegum, berry, vanilla, or other scents and flavorings that can be embedded into a nylon rope or a cotton rope to enhance the puzzle's use for vision impaired people.

The didactic skill developing puzzle can have a body formed from four different loops that can engage a center segment.

The center segment can have a first end and a second end. The center segment can be an open continuous loop of plastic tubing, or the center segment can be a continuous loop of plastic tubular material. The continuous loop of plastic tubular material can have a flat space for imprinting a message.

The apparatus can also function as a marketing tool, which can provide space advertising space for a sponsor, such as the "Lighthouse" center for the blind project.

The puzzle can have a right side large loop mounted to a first snap connection. The first snap connection can removeably connect the right side large loop to the center segment at a first web.

The puzzle can have a right side small loop mounted to a second snap connection. The second snap connection can removeably connect the right side small loop to the center segment at the first web opposite the first snap connection.

A detachable and openable first connected end can be formed when the first snap connection engages the second snap connection with the first web in-between the two removable snap connections on a first end of the center segment, thereby forming ½ of the puzzle.

The puzzle can have a left side that can be formed substantially similar to the right side of the puzzle. The puzzle can have a left side large loop mounted to a third snap connection. The third snap connection can engage a second web for connecting the left side large loop to the center segment.

The first web and the second web can be formed as part of the center segment. Each of the two webs can have alignment holes for engaging both of the snap connections.

The puzzle can have a left side small loop. A fourth snap connection can be secured to the left side small loop.

The fourth snap can connect the left side small loop to the center segment at the second web.

A second connected end can be formed when the third snap connection connects via the second web to the fourth snap connection on the second end of the center segment.

In one or more embodiments, when all of the snaps are engaged the loops do not touch each other, and only touch at the now formed connected ends.

The right side large loop can cross a horizontal plane of the puzzle without touching the right side small loop.

Additionally, the right side small loop can cross the horizontal plane of the puzzle without touching the left side small loop.

The left side small loop can cross the horizontal plane of the puzzle without touching the right side small loop. Also, the left side small loop can cross the horizontal plane of the puzzle without touching the left side large loop.

All loops can cross each other at a first location without touching. All loops can cross at a second location without touching the vertical plane of the puzzle.

To operate the puzzle, a continuous loop of material with an openable clasp can be positioned around the center segment between the loops, which can allow a user to calculate a number of steps to experience a three dimensional maze and remove the continuous loop of material without using the openable clasp to didactically develop deductive abilities, improve memory, and improve reasoning.

The loops and the center segment can be hollow or solid.

The loops and the center segment can have the form of a special shape, like Mickey Mouse™ ears, the shape of the head of Shamu™ from Seaworld™, or of a company logo.

In embodiments, the center segment can have an imprint space for a sporting printing, a message, a logo, or even a bible saying.

In embodiments, the center post or segment can be an elliptical loop of parallel rails connected by rounded edges with space in between, such that the puzzle can be hung up easily for easy access and use.

The continuous loop of material can be a rope, a ball chain, a leather cord, or combinations of these materials. The material can be a braided cotton cloth that can be very thin and can be immersed in a smell or a flavoring, such as a lemon scent, in order to create a "smellable" puzzle.

In embodiments, the continuous loop of material can be a plastic tube, such as a translucent plastic tube, containing a small light emitting diode connected to a power supply, thereby enabling a user to use the puzzle where it is otherwise dark. The power supply can be a lithium ion miniature battery. In embodiments, the battery can be external to the loops and positioned on one of the connectors.

In embodiments, the loops, the center segment, and the snap connections can form the body, which can be made of a plastic material, such as polyethylene, polypropylene, polycarbonate, a homo-polymer, or combinations thereof. The snap connections can also be made from these materials. The loops can be formed from the same materials, or the loops can be made of a different material to provide more flexible loops with rigid snap connections.

In embodiments, the loops can be made from a metal, a silica based product, a wood based product, or combinations thereof.

In embodiments, at least a partial coating can be disposed over at least a portion of the loops. The coating can be a pigment or a scent.

In embodiments, the partial coating can be a metal plating, such as a chrome plating or a urethane based product. Combinations of these coatings can be used to make the puzzle sparkle, smell delicious, provide a texture so that large loops feel one way while small loops feel another way, or to increase tactile development while using the puzzle.

In embodiments, the center segment can have two webs. Each web can have a pair of alignment holes in a spaced apart relationship. The first alignment hole can have a diameter from about one millimeter to about two millimeters and can be spaced about one millimeter from the second alignment hole.

The first snap connection can have a first web slot for engaging a first web portion. The first snap connection can have a first post extending from it to penetrate one of the alignment holes of the first web.

The first snap connection can have a first male snap extension for connecting to the second snap connection without passing through the web.

The first snap connection can have a first female snap receptacle for engaging a second male snap extension from the second snap connection.

The first snap connection can have a first hole for engaging a second post from the second snap connection through a second alignment hole in the first web.

The second snap connection can have a mirror image of the first snap connection with a second web slot for engaging a second web portion.

The second snap connection can have a second male snap connection for engaging the first female snap receptacle without passing through the first web.

The second snap connection can have a second female receptacle for engaging the first male snap extension.

The second snap connection can have a second hole for engaging the first post through one of the alignment holes of the first web.

The second snap connection can have a second post for engaging the first hole through the alignment hole of the first web.

The third snap connection can be a copy of the first snap connection, and the fourth snap connection can be a copy of the second snap connection.

In embodiments, the center segment can have a first end and a second end. The first end can have a first opening, and the second end can have a second opening for ease of transport and storage. The first opening and the second opening can be elliptical in shape, rectangular in shape, curvilinear in shape, or some other shape that can enable the puzzle to be hung from a backpack or a hook.

Embodiments can have loops full of light emitting diodes "LED" lights, such that the puzzle can produce a light show when the puzzle is twirled. The puzzle can illuminate a darkened room. The puzzle can include an on-off switch for turning the lights on or off to extend battery life.

The continuous loop of material can be a length from about two to six times the overall length of the loops. The continuous loop of material for a small puzzle can be six inches long. The continuous loop of material for a larger puzzle can be eighteen inches long, or even thirty six inches long.

Each loop can have a distinctive smell.

The puzzle can have at least two continuous loops of material simultaneously for dual logic solving use. Each loop of material can be a different substance or a different smell. For example, a chain of metal might be one loop; an elastic material might be the second loop. The two loops can be used together to solve the puzzle without tangling the loops up.

Turning now to the Figures, FIG. 1 is a top perspective view of the assembled didactic skill developing puzzle.

The right side large loop 20, the right side small loop 24, the left side large loop 32, and the left side small loop 36 are depicted.

The snap connections are shown connected together over each of the webs and forming the first connected end 28 and the second connected end 40. The snap connections can non-removably or removably engage each of the loops.

Figure 2:
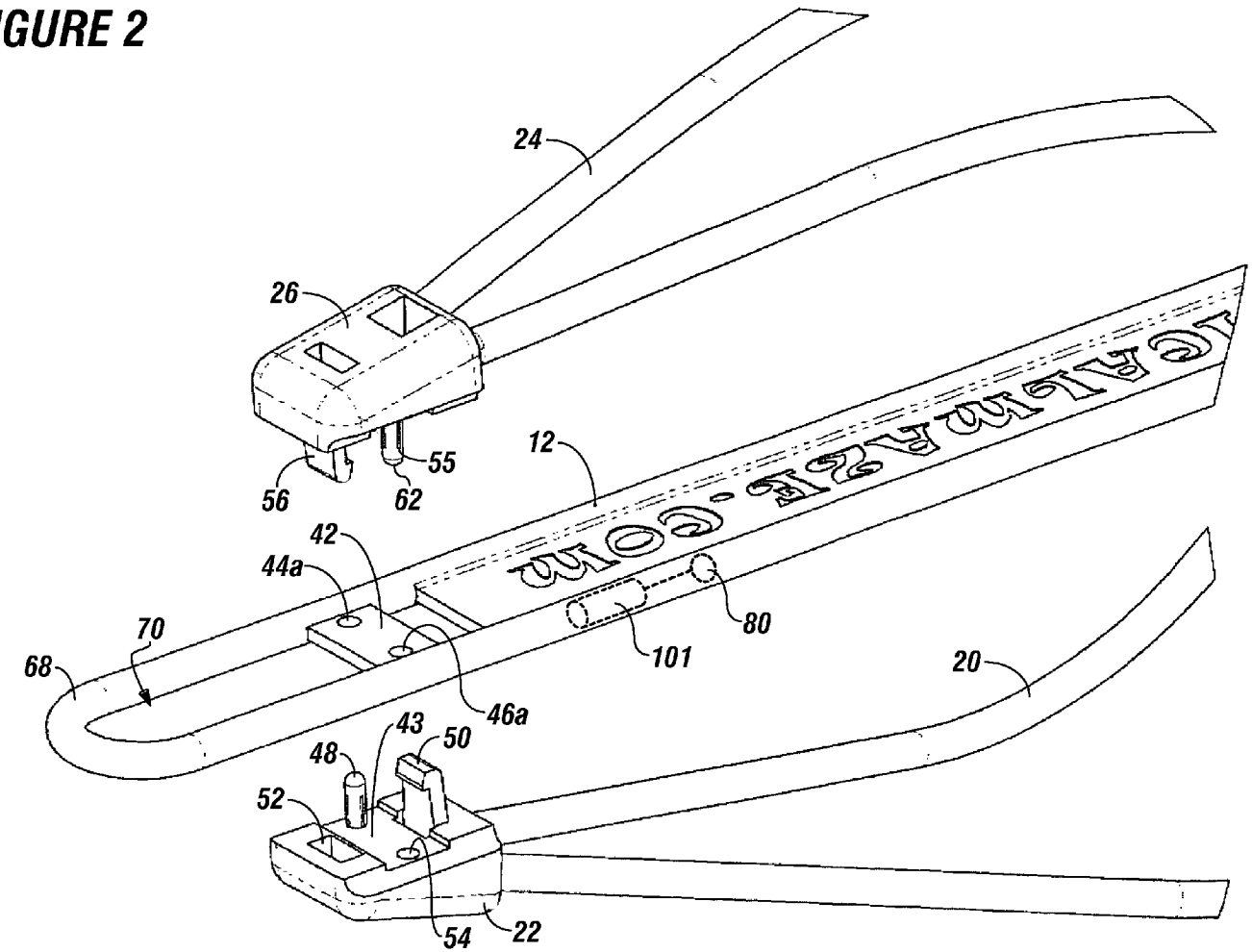
FIG. 2 is a detailed view of snap connections used with the didactic skill developing puzzle.

FIG. 2 is an exploded detailed view of the snap connections used with the didactic skill developing puzzle.

The right side large loop 20 can be disposed on one side of the center segment 12. The right side small loop 24 can be disposed on the opposite site of the center segment 12.

Snap connections can be connected to each of the loops. The first snap connection 22 can have a first post 48 with crush ribs on the outside for providing a snug interference fit.

The first male snap extension 50 can project away from the face of the first snap connection 22.

The face of the first snap connection 22 can have a first web slot 43 for engaging a first web portion 42.

The first snap connection 22 can have a first female snap receptacle 52 for engaging a second male snap extension 56 from the second snap connection 26.

A first hole 54 can be formed in the first web slot 43 for engaging the second post 62 of the second snap connection 26.

The second snap connection 26 can have a second web slot 55 and can engage the first web portion 42 opposite the first snap connection 22.

The second male snap connection 56 can project from the face of the second snap connection 26 along with the second post 62.

The center segment 12 can have parallel rails with rounded ends that can form the first end 68 with the first opening 70.

The center segment 12 can have a first alignment hole 44*a* and a second alignment hole 46*a*.

The second snap connection 26 can have a second female receptacle and a second hole that can enable the first post to engage the second hole through one of the two alignment holes 44*a* or 46*a* of the first web 42.

The center segment 12 can have a light emitting diode 80 disposed therein and connected to a power supply 101.

Figure 3:
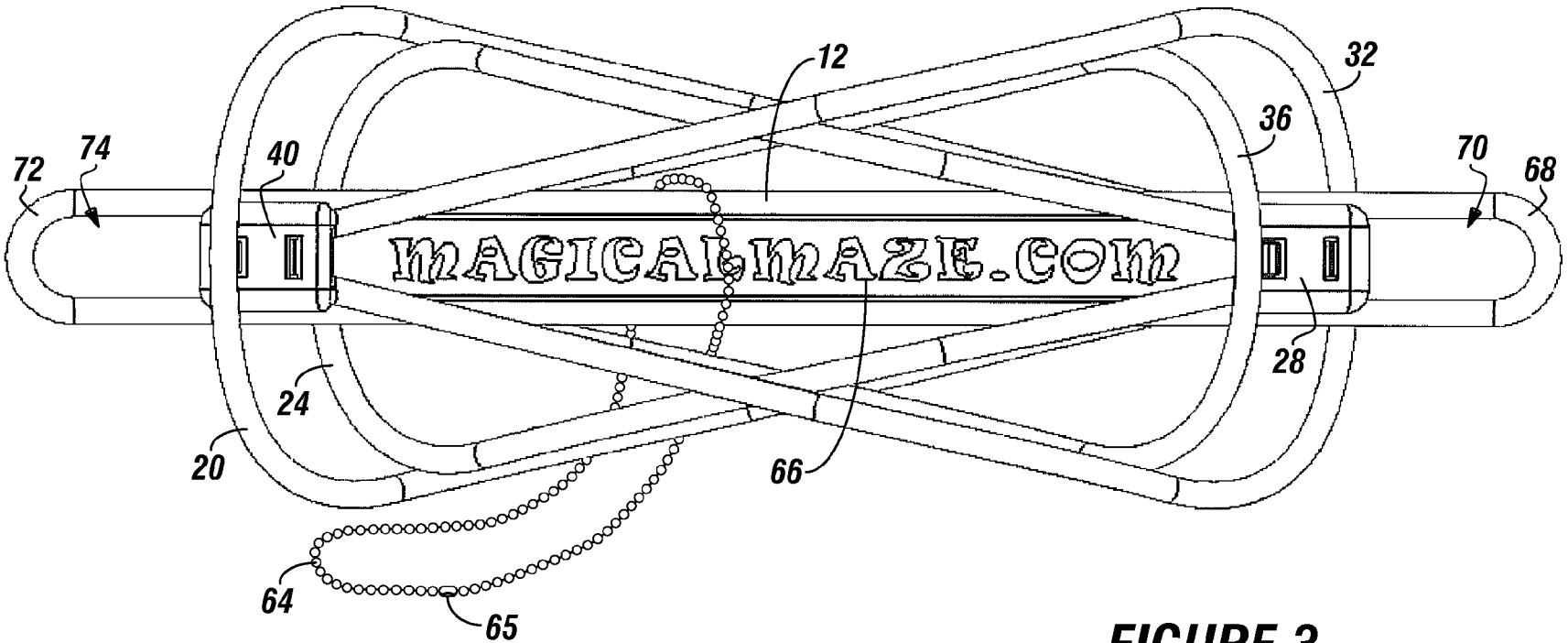
FIG. 3 is a top view of the didactic skill developing puzzle with material in the starting position to solve the puzzle.

FIG. 3 is a top view of the didactic skill developing puzzle with one loop of continuous material 64 disposed in the starting position to solve the puzzle. The loop of continuous material 64 is shown as a ball chain with an openable clasp 65.

The loop of continuous material 64 can be a rigid tubing. The rigid tubing can be somewhat flexible. The rigid tubing can be formed from polycarbonate having a diameter of 1/32 to 1/18 inches.

The center segment 12 can have an imprint space 66 for a message, such that the puzzle can be both a development tool and a marketing tool.

The second end 72 can have a second opening 74.

The right side large loop 20, the right side small loop 24, the left side large loop 32, and the left side small loop 36 can each be viewed in an overlapping but not touching configuration.

Figure 4:
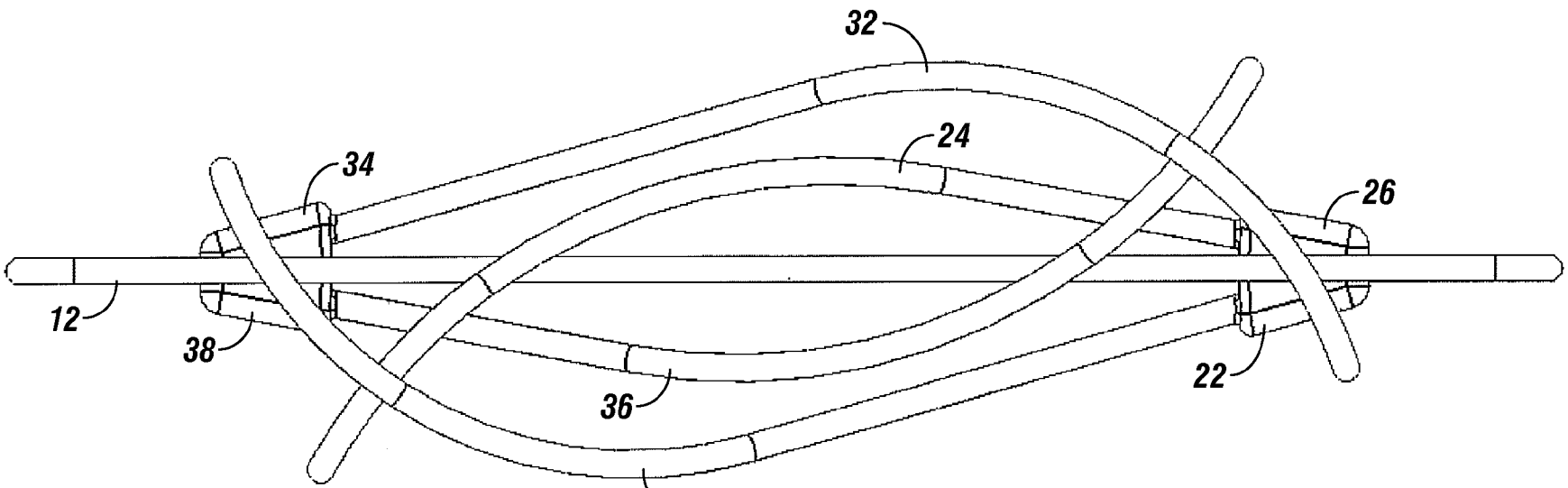
FIG. 4 is a side view of the assembled didactic skill developing puzzle showing the intersection of loops and arcs.

FIG. 4 is a side view of the assembled didactic skill developing puzzle showing the intersection of the loops and the arcs.

The left side large loop 32 can be disposed over the right side small loop 24. The left side small loop 36 can be disposed between the center segment 12 and the right side large loop 20.

The first snap connection 22 can be connected to the center segment 12 opposite the second snap connection 26. The third snap connection 34 can be connected to the center segment 12 opposite the fourth snap connection 38.

Figure 5:
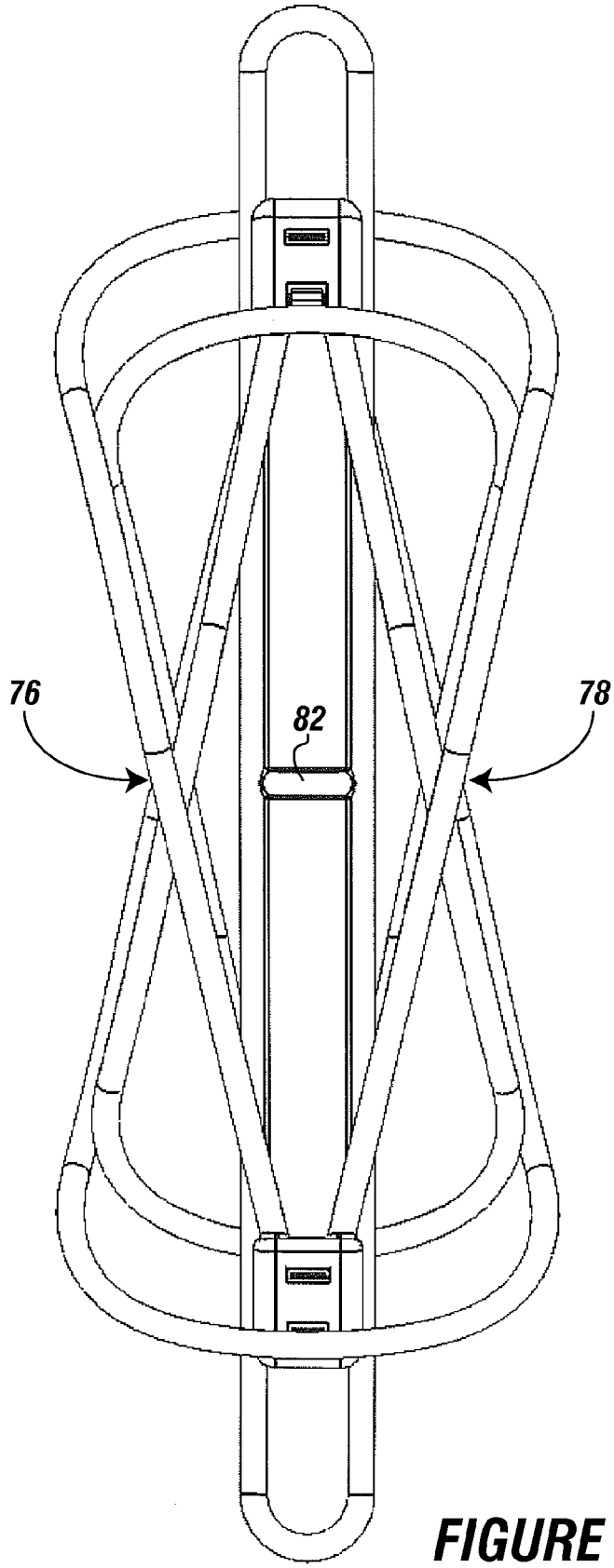
FIG. 5 is a bottom view of the assembled didactic skill developing puzzle with the first and second locations identified.

FIG. 5 is a bottom view of the assembled didactic skill developing puzzle with the first location 76 and the second location 78 identified where the loops can cross in the vertical plane of the puzzle.

An injection canal 82 can allow for injecting of lights or a sparkly liquid material into a hollow tube version of the center segment.

Figure 6:
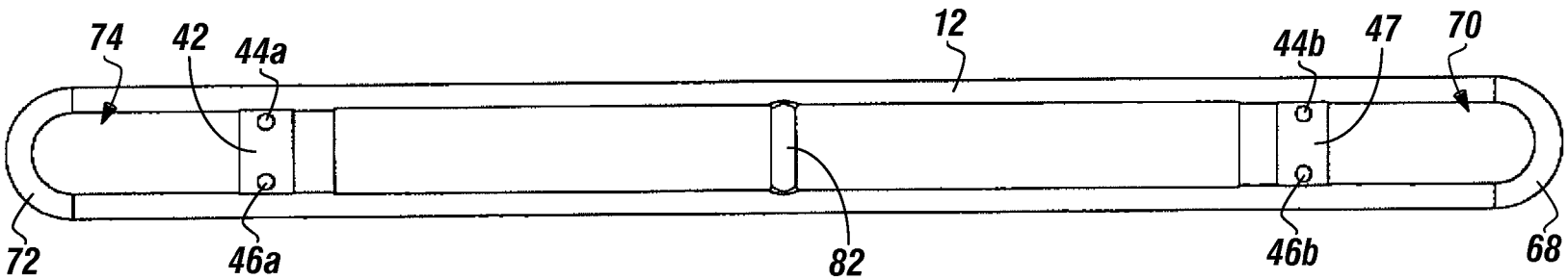
FIG. 6 is a bottom view of a center segment used in the assembled didactic skill developing puzzle.

FIG. 6 is a bottom view of the center segment 12. The center segment 12 can have the first web 42 and a second web 47.

The first web 42 can have the first alignment hole 44*a* and the second alignment hole and 46*a*. The second web 47 can have the third alignment hole 44*b* and the fourth alignment hole 46*b*.

The first opening 70 and the second opening 74 can each have an area from about 1/32 of an inch to about 1/2 of an inch.

While these embodiments have been described with emphasis on the embodiments, it should be understood that within the scope of the appended claims, the embodiments might be practiced other than as specifically described herein.

What is claimed is:

1. A didactic skill developing puzzle comprising:

a. a center segment with a first end and a second end, wherein the first end has a first web and the second end has a second web;

b. a right side large loop with a first snap connection, wherein the first snap connection removeably connects the right side large loop to the first web of the center segment;

c. a right side small loop with a second snap connection, wherein the second snap connection removeably connects the right side small loop to the first web of the center segment, and wherein the second snap connection removeably engages the first snap connection through the first web to form a first connected end;

d. a left side large loop with a third snap connection, wherein the third snap connection removeably connects the left side large loop to the second web of the center segment;

e. a left side small loop with a fourth snap connection, wherein the fourth snap connection removeably connects the left side small loop to the second web of the center segment, wherein the fourth snap connection removeably engages the third snap connection through the second web to form a second connected end, and wherein:

(i) the right side large loop crosses a horizontal plane of the didactic skill developing puzzle without touching the right side small loop;

(ii) the right side small loop crosses the horizontal plane of the didactic skill developing puzzle without touching the left side small loop;

(iii) the left side small loop crosses the horizontal plane of the didactic skill developing puzzle without touching the right side small loop;

(iv) the left side small loop crosses the horizontal plane of the didactic skill developing puzzle without touching the left side large loop; and (v) each loop crosses another loop at a first location without touching and at a second location without touching;

f. at least one continuous loop of material with an openable clasp positioned around the center segment and between each of the loops.

2. The didactic skill developing puzzle of claim 1, wherein the center segment is solid.

3. The didactic skill developing puzzle of claim 1, wherein the center segment comprises an imprint space.

4. The didactic skill developing puzzle of claim 1, wherein the center segment is an elliptical loop of parallel rails connected by rounded edges.

5. The didactic skill developing puzzle of claim 1, wherein the at least one continuous loop of material is a rope, a ball chain, a cotton braided fabric, a leather cord, or combinations thereof.

6. The didactic skill developing puzzle of claim 1, wherein the right side small loop, the right side large loop, the left side large loop, and the left side small loop each comprise: a plastic, a metal, a silica based product, a wood based product, or combinations thereof.

7. The didactic skill developing puzzle of claim 6, further comprising a partial coating disposed over at least a portion of the right side large loop, the right side small loop, the left side large loop, the right side small loop, or combinations thereof.

8. The didactic skill developing puzzle of claim 7, wherein the partial coating is a metal plating, a pigment, a urethane based product, or combinations thereof.

9. The didactic skill developing puzzle of claim 1, wherein the first web has a first alignment hole and a second alignment hole.

10. The didactic skill developing puzzle of claim 9, wherein the first post and the second post pass through the first alignment hole and the second alignment hole of the first web, and wherein the second web has a pair of alignment holes for engaging the second web of the center segment.

11. The didactic skill developing puzzle of claim 1, wherein the first snap connection has a first web slot for engaging a first web portion, a first post, a first male snap extension, a first female snap receptacle, and a first hole.

12. The didactic skill developing puzzle of claim 11, wherein the second snap connection has a second web slot for engaging a second web portion, a second male snap connection for engaging the first female snap receptacle, a second female receptacle for engaging the first male snap extension, a second hole for engaging the first post, and a second post for engaging the first hole.

13. The didactic skill developing puzzle of claim 1, wherein the first end comprises a first opening, and wherein the second end comprises a second opening.

14. The didactic skill developing puzzle of claim 1, wherein the at least one continuous loop of material has a length from two to six times a combined overall length of: the right side large loop, the right side small loop, the left side large loop, and the right side small loop.

15. The didactic skill development puzzle of claim 1, wherein the at least one continuous loop of material comprises a distinctive smell.

16. The didactic skill development puzzle of claim 1, further comprising a second continuous loops of material for dual logic solving use.

17. The didactic skill development puzzle of claim 1, wherein the center segment is a translucent plastic tube containing at least one small light emitting diode connected to a power supply.

18. The didactic skill development puzzle of claim 1, wherein the at least one continuous loop of material is a translucent plastic tube containing at least one small light emitting diode connected to a power supply.

19. A didactic skill developing puzzle comprising:

a. a center segment comprising a first end and a second end, wherein the first end comprises a first web and the second end comprises a second web;

b. a right side large loop comprising a first snap connection, wherein the first snap connection engages the right side large loop to the first web;

c. a right side small loop comprising a second snap connection, wherein the second snap connection engages the right side small loop to the first web, and wherein the second snap connection engages the first snap connection through the first web to form a first connected end;

d. a left side large loop comprising a third snap connection, wherein the third snap connection engages the left side large loop to the second web;

e. a left side small loop comprising a fourth snap connection, wherein the fourth snap connection engages the left side small loop to the second web, wherein the fourth snap connection engages the third snap connection through the second web to form a second connected end, and wherein:

(i) the right side large loop crosses a horizontal plane of the didactic skill developing puzzle without touching the right side small loop;

(ii) the right side small loop crosses the horizontal plane of the didactic skill developing puzzle without touching the left side small loop;

(iii) the left side small loop crosses the horizontal plane of the didactic skill developing puzzle without touching the right side small loop;

(iv) the left side small loop crosses the horizontal plane of the didactic skill developing puzzle without touching the left side large loop; and (v) each loop crosses another loop at a first location without touching and at a second location without touching;

f. a continuous loop of material disposed around the center segment and between each of the loops.

* * * * *